United States Patent [19]

McDonald

[11] Patent Number: 4,687,369

[45] Date of Patent: Aug. 18, 1987

[54] TRAFFIC FLOW INDICATOR FOR ROADWAY PLACEMENT

[76] Inventor: Gerald R. McDonald, 40960 McKenzie Hwy., Springfield, Oreg. 97478

[21] Appl. No.: 871,926

[22] Filed: Jun. 9, 1986

Related U.S. Application Data

[63] Continuation-in-part of Ser. No. 739,318, May 30, 1985, abandoned, which is a continuation-in-part of Ser. No. 644,623, Aug. 27, 1984, abandoned.

[51] Int. Cl.[4] ..... E01F 9/06

[52] U.S. Cl. ..... 404/12; 404/13; 116/63 P

[58] Field of Search ..... 404/6, 9, 10, 12–14, 404/32, 35, 41; 116/63 P, 63 R

[56] References Cited

U.S. PATENT DOCUMENTS

| | | | |
|---|---|---|---|
| 1,833,124 | 11/1931 | Rand | 404/10 |
| 2,136,709 | 11/1938 | Robertson | 404/13 |
| 2,680,698 | 6/1954 | Schnee | 404/35 |
| 2,851,935 | 9/1958 | Weeks | 404/13 |
| 3,334,554 | 8/1967 | Adams | 116/63 P |

*Primary Examiner*—Stephen J. Novosad
*Assistant Examiner*—John F. Letchford
*Attorney, Agent, or Firm*—James D. Givnan, Jr.

[57] ABSTRACT

A marker of thick elastomeric sheet material for temporary rested placement on a road surface to indicate a detour lane about a construction site or the like. The marker is of arrow shape. Openings in the marker provide handgrips for convenient handling of the marker during setting out and retrieval of same. A modified arrow is of segmented construction and of variable length and may be placed on a road surface. A further modified marker includes separate head and main body portions which include a coupling arrangement for joining the portions in the field.

7 Claims, 13 Drawing Figures

TRAFFIC FLOW INDICATOR FOR ROADWAY PLACEMENT

BACKGROUND OF THE INVENTION

The present application is a continuation-in-part patent application of a co-pending earlier application filed by the same inventor on May 30, 1985, under Ser. No. 06/739,318, abandoned, and having the same title as the present application and which was a continuation-in-part patent application of an earlier co-pending application filed by the present inventor on Aug. 27, 1984, under Ser. No. 06/644,623, abandoned.

The present invention pertains to roadway markers for temporary placement on a street or road surface to guide motorists about an obstruction.

During the performance of road repairs or construction services, it is often necessary to temporarily divert traffic flow around the work site by setting up temporary lanes. Such diversion of traffic is commonly done with brightly colored cone shaped markers or posts mounted on platforms. Such markers are typically set out to define a curved traffic lane or lanes about a work site.

A problem exists in that from a distance it is difficult for a driver to detect the intended path particularly if the temporary lane has abrupt changes of directions. It is possible that a motorist may miss the cone or post marked lane particularly if distracted by construction work to jeopardize both workers and equipment. This is particularly so if the cones or posts are not set close to one another but rather, as is often the case, set in a manner leaving gaps of several feet between successive cones. The problem is complicated when an oncoming, adjacent lane is set up as it is possible for a confused drive to enter the oncoming lane.

The use of cone or post shaped marker in an optimum closely spaced manner represents considerable expense to the governmental agency or contractor involved since such markers are costly.

SUMMARY OF THE PRESENT INVENTION

The present invention is embodied within a marker for temporary placement on a road surface to guide a vehicle driver about a construction site.

The marker embodying the present invention is of an arrow configuration for placement on a roadway surface to indicate the center of a temporary traffic lane. The markers are used in series spaced from one another to be highly visible and to provide an unmistakable course for the motorist to follow. Each marker is formed so as to lie in an adhering manner on a road surface regardless of existing weather conditions and is not susceptible to displacement by vehicle tires. Further, means are provided to enable convenient handling and storage of the markers in a vehicle. If desired, such markers may include a word display, reflective surfaces and may be adapted for securement to an underlying surface. The head portion of a still further modified traffic lane marker defines an open area or mortise within which is received cooperating joint structure formed at one end of an attachable main body portion. Accordingly, the head portion may be of triangular shape and joined with an elongate main body portion in the field.

Important objectives of the present marker include the provision of a roadway marker for temporary placement on a road surface to indicate to the motorist the center of a temporary lane; the provision of a roadway marker that lends itself to convenient handling during both setting out and retrieval as well as storage of same; the provision of a marker with an open area defined therein to to provide a handgrip; the provision of a lane marker to indicate a lane center between lane boundary markers such as cones or posts; the provision of a traffic lane marker which may be of segmented construction enabling a marker to be assembled of considerable length yet one easily handled and stored; the provision of a traffic lane marker with upper and side wall reflective surfaces; the provision of a traffic lane marker which may receive fastening elements for temporary securement of the marker to the roadway surface; the provision of a traffic lane marker having head and main body portions respectively of triangular and elongate shape with both portions including coupling means permitting joining as well as detachment of said portions in the field to facilitate use of the marker; the provision of a traffic lane marker wherein a triangular head portion enables optimum utilization of strip material from which the head portion is formed.

DETAILED DESCRIPTION OF THE PREFERRED EMBODIMENTS

Figure 1:
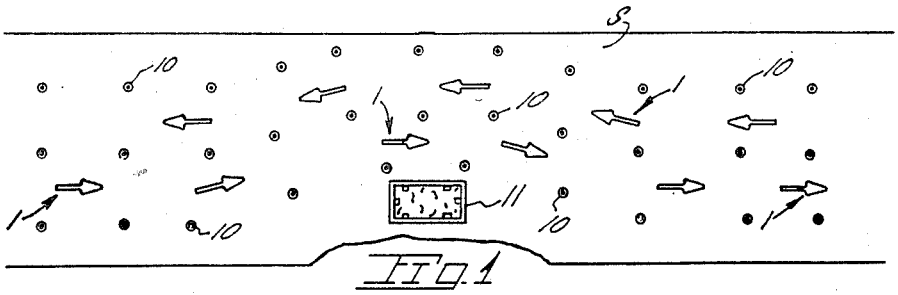
FIG. 1 is a plan view of the present marker in use to indicate a temporary traffic pattern.
Figure 2:
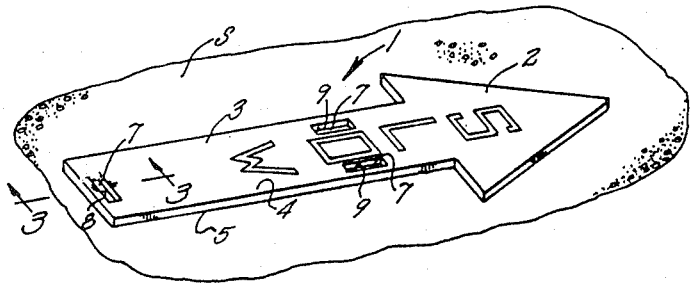
FIG. 2 is a perspective view of the marker in place on a road surface.

With continuing attention to the drawing wherein applied reference numerals indicate parts similarly hereinafter identified, the reference numeral 1 indicates generally a traffic lane marker embodying the present invention.

The marker includes an enlarged head portion 2 in the configuration of an arrowhead while an integral rectangular main body portion is at 3. Upper and lower surfaces of the marker are at 4 and 5.

Figure 4:
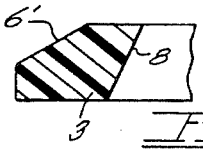
FIG. 4 is a sectional view similar to FIG. 3 but showing a modified marker edge surface.

The marker is of planar construction with bottom surface 5 for rested contact with a road surface S. The material used for the present marker is of an elastomeric nature with a thickness preferably of about five eighths inch to provide a marker of substantial mass and one not susceptible to accidental displacement by wind or vehicle wheels passing thereover. An upper perimeter at 6 of the marker may be chamfered as at 6' in FIG. 4 to reduce the vertical edge surface area of the marker to render same less susceptible to displacement.

Open areas as at 7 may be provided in the main body portion 3 for the purpose of providing a handgrip embodied in an internal edge area 8 of main portion 3. Similarly, if desired, other open areas 7 may be provided at the markers center of gravity with such providing an edge area 9 to form a central handgrip. The openings greatly facilitate carrying of the marker and setting out and retrieving of same. Such openings also facilitate storage of the marker on a rack having an arm which projects through an open area 7.

Figure 3:
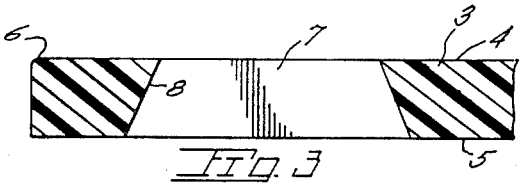
FIG. 3 is a sectional view taken along line 3—3 of FIG. 2.

The edge areas 8 and 9 may be undercut as typically shown in FIG. 3 to facilitate manual lifting of the marker.

The marker may be molded from a durable synthetic elastomer such as polyvinyl of a density to provide a marker of adequate weight to prevent accidental displacement as earlier noted. Marker size may be four feet or so in length. Marker thickness may range from one quarter of an inch or so to about one inch.

In use, the markers are deposited on a ground surface preferably medially between cones or posts at 10 and at intervals to clearly indicate to a vehicle driver the desired course around an obstacle at 11. The markers may be provided with wording to best suit the intended use.

Figure 5:
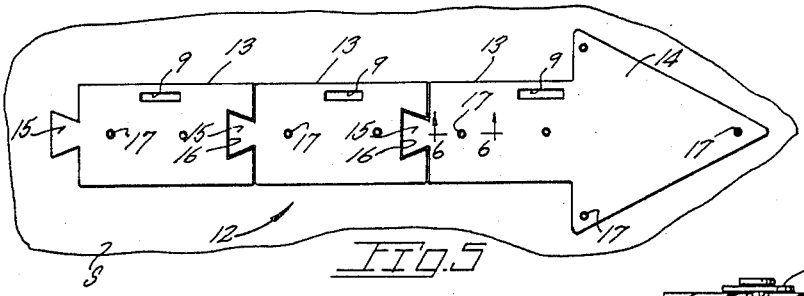
FIG. 5 is a top plan view of a further modified form of the marker.
Figure 6:
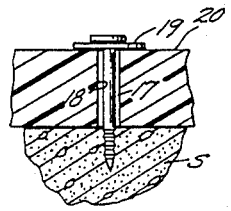
FIG. 6 is a vertical sectional view taken along line 6—6 of FIG. 5.
Figure 7:
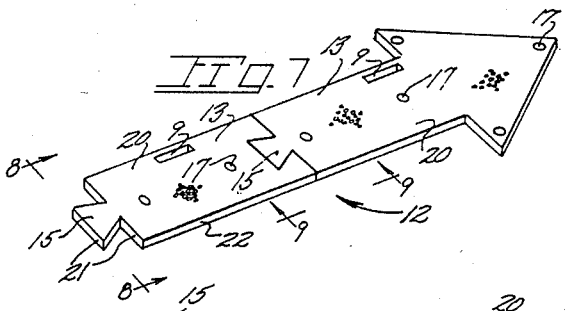
FIG. 7 is a perspective view of a modified marker.
Figure 8:
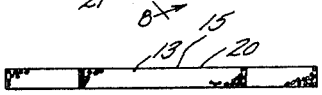
FIG. 8 is an end elevational view taken along line 8—8 of FIG. 7.
Figure 9:
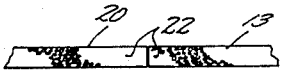
FIG. 9 is a side elevational view of the marker taken along line 9—9 of FIG. 7.

In FIG. 5 a further modified marker is indicated generally at 12 which is of segmented construction with marker segments indicated at 13. A triangular head portion is at 14. The main body segments or portions 13 are jointed so as to be attachable to one another to enable the user to select a desired length to best suit the traffic situation encountered. For this purpose joints are embodied in tenons 15 which are received in mortises 16 in interlocking fashion. The coupling of the main body portion segments in the manner indicated prevents displacement of the segments by tire passage thereover. If desired, the main body segments 13 and head portion 14 may be additionally secured against displacement by the insertion of fasteners 17. Said fasteners are received within openings 18 extending through the marker. A fastener inserted through the marker and into an underlying roadway surface S prevents theft as well as unauthorized movement of same. A washer 19 provides a bearing surface against which a removal tool may be applied during extraction of the fastener and prevents damage to the pliable marker material.

To enhance the markers visibility at night, the markers upper surface at 20 may be provided with reflective material such as reflective beads. Similarly, the end and side walls of the markers at 21 and 22 may be provided with reflective material.

Figure 10:
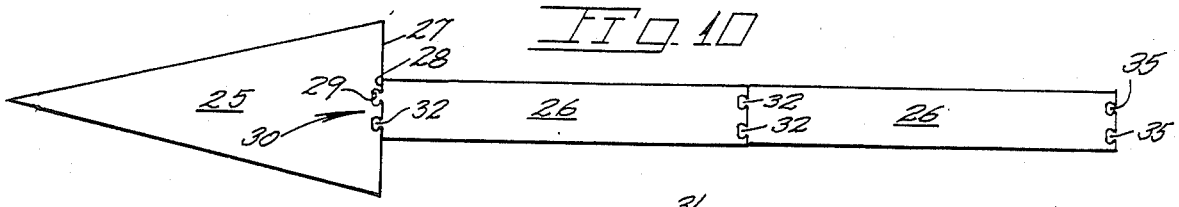
FIG. 10 is a plan view of a modified form of the marker.
Figure 11:
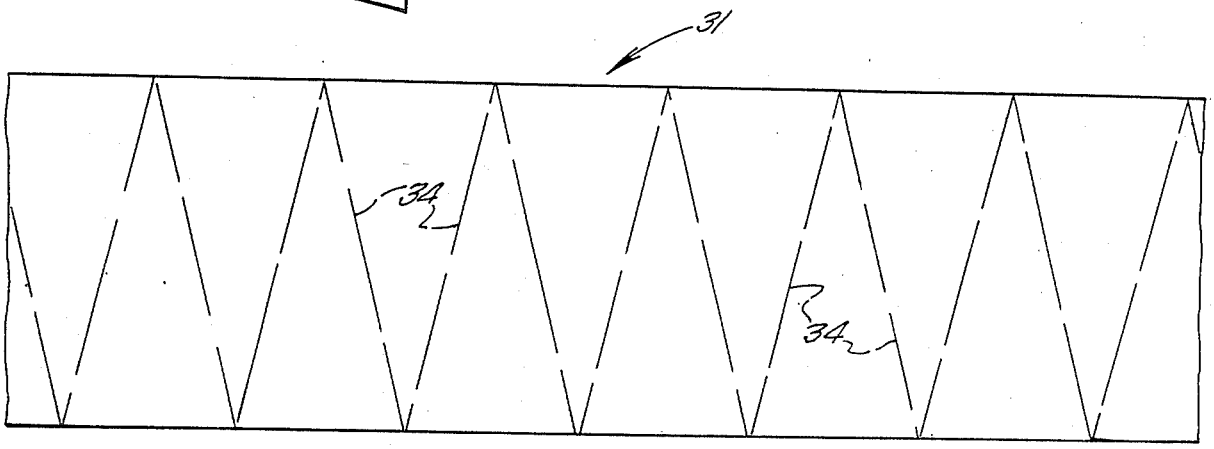
FIG. 11 is a plan view of a strip of planar material with head portions shown in dashed lines prior to cutting of the strip material.
Figure 12:
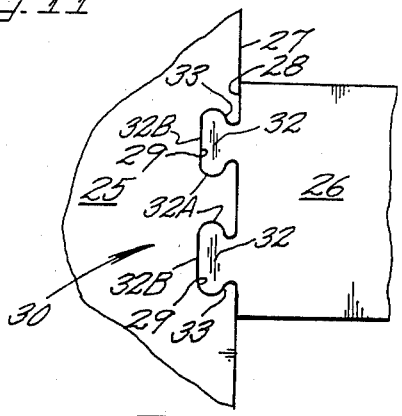
FIG. 12 is an enlarged fragmentary view of FIG. 10 showing the coupling means between head and main body portions of the arrow.
Figure 13:
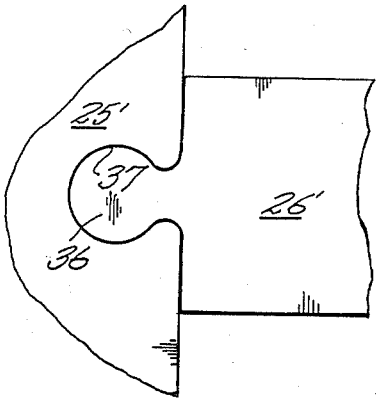
FIG. 13 is a view similar to FIG. 12 but showing a modification of the coupling means.

The preferred form of traffic lane marker or indicator shown in FIG. 10 and associated later Figures incorporates a coupling arrangement between a head portion at 25 and an elongate main body portion at 26. The head portion is triangular having a side 27 which abuts an end 28 of the main body portion. Coupling means generally at 30 joins the head and main body portions and may be in the general nature of a mortise and tenon joint. Mortises at 29 formed within the head portion permit the head portion to be formed from a strip of elastomeric material generally at 31, as per FIG. 11, to effect both ease and economy of manufacture with several head portions are formed from the strip later cut along lines at 34. Tenons at 32 fit in a snug manner within the mortises and preferably are undercut at 33 to cooperate with the correspondingly shaped mortises to prevent separation of the marker portions. Forming of the mortises and tenons in pairs also contributes to secure coupling of the head and body portions.

The remaining end of each main body portion may include additional coupling means embodied mortises as at 35 and tenons 32 of an attached elongate main body portion. Tenon 32 has both curved and straight edges at 32A and 32B. A single tenon at 36 may be of circular shape within a circular mortise 37 in a modified arrow marker having head and body portions at 25' and 26'.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

1. A highway traffic lane marker for temporary placement on a roadway surface to indicate traffic flow around an obstruction, said marker comprising, a main body portion of elongate shape, a head portion of generally triangular shape and having one side in abutment with one end of said main body portion, said main body portion and said head portion both including coupling means joining said main body portion to said head portion, and said main body portion including additional coupling means disposed at the remaining end of the main body portion.

2. The traffic lane marker claimed in claim 1 wherein said coupling means and said additional coupling means each include multiple mortises and tenons.

3. The traffic lane marker claimed in claim 1 wherein said coupling means and said additional coupling means on said main body includes tenons at said one end of said main body portion and mortises at said remaining end of said main body portion.

4. The traffic flow marker claimed in claim 3 wherein said mortises and tenons have curved edges.

5. The traffic flow marker claimed in claim 4 wherein said head portion defines multiple mortises located along said one side.

6. The traffic lane marker claimed in claim 5 wherein said edges are straight.

7. The traffic lane marker claimed in claim 5 wherein said edges include both straight and curved edges.

* * * * *